US005232385A

United States Patent [19]

Hatfield

[11] Patent Number: 5,232,385

[45] Date of Patent: Aug. 3, 1993

[54] GAS TURBINE POWERED SHIP

[75] Inventor: John E. Hatfield, Coventry, United Kingdom

[73] Assignee: Rolls-Royce plc, London, England

[21] Appl. No.: 836,743

[22] Filed: Feb. 19, 1992

[30] Foreign Application Priority Data

Feb. 20, 1991 [GB] United Kingdom ..... 9103534

[51] Int. Cl.[5] ..... B63H 11/09

[52] U.S. Cl. ..... 440/44; 114/334

[58] Field of Search ..... 114/211, 212, 334, 270; 440/44, 45

[56] References Cited

U.S. PATENT DOCUMENTS 2,390,557 12/1945 Scaife ..... 114/334
3,714,920 2/1973 Setterblade .
3,863,584 2/1975 Wilkins ..... 114/334

FOREIGN PATENT DOCUMENTS 1022324 3/1966 United Kingdom .

*Primary Examiner*—Jesûs D. Sotelo

*Attorney, Agent, or Firm*—Cushman, Darby & Cushman

[57] ABSTRACT

A twin-hulled ship is powered by a gas turbine engine in each hull, the engine being located near the waterline in vertical alignment with a position outboard of the superstructure's internal sidewall, but preferably inboard of the superstructure's external sidewall. This is facilitated by the outward bulge of the hull relative to the superstructure's external sidewall. An air inlet filter bank is mounted in the side of the superstructure sufficiently far above the waterline to avoid swamping. Air intake ducting leads from the filter bank to the engine, and exhaust ducting leads from the engine to an exhaust outlet at a higher level than the filter bank. This arrangement enables intrusion of intake and exhaust ducting into the main loading deck space to be avoided while minimizing deviation of intake and exhaust ducting from a straight line path. Preferably, to minimize spoiling of the lines of the ship's sides, the filter bank and the intake and exhaust ducting are housed entirely between the superstructure's internal and external sidewalls.

16 Claims, 4 Drawing Sheets

GAS TURBINE POWERED SHIP

The present invention relates to ships powered by gas turbine engines. In particular, it is concerned with an improved mode of gas turbine powerplant installation for twin-hulled roll-on/roll-off (RO-RO) ferries, though it is not restricted to such vessels.

Some current designs of roll-on/roll-off ferries for relatively short sea passages are twin-hulled designs. The engines are housed in the base of the hulls near the waterline, with power offtake shafts extending sternwards to the propulsors, which may comprise waterjets. These vessels are designed for high speeds, with small wetted hull areas to minimise drag from the water. Their loading decks are arranged to span the distance between the two hulls at as low a level as possible compatible with the seagoing ability required by the vessel and the rest of their superstructures are designed as far as possible with long low continuous lines to minimise aerodynamic drag and susceptibility to cross winds and to obtain the greatest possible stability for the vessel. A further design aim is to maximise cargo capacity.

Hitherto known modes of installation of gas turbine engine powerplants in such vessels have involved use of the superstructure to support exhaust silencers, air intakes and their associated ducting at a high level, producing funnel-like structures which add top weight to the ship and increase wind resistance. This approach has also required intrusion of engine air intake ducts and exhaust ducts into otherwise revenue-earning deckspace above the two hulls. Further problems have been that there have been large pressure losses in the ducting associated with high level intakes, together with aerodynamic disturbance of the air flow into the compressor of the gas turbine engine.

The present invention seeks to provide modes of installation which reduce or eliminate these penalties.

A further object is to improve the aerodynamics of the installation with regard to entry of air into the compressor of the gas turbine engine.

Accordingly, the present invention provides a gas turbine powered ship having at least one gas turbine engine power plant installed in a hull of the ship, an air intake filter bank located in the side of the ship sufficiently far above the waterline to avoid swamping of the filter bank in those seastates for which the ship is designed, air intake duct means leading from the intake filter bank to the engine, and exhaust duct means leading from the engine up to exhaust outlet means at a higher level than the intake filter. Preferably, the intake filter bank is housed substantially completely within the side of the ship such that the outer surface of the filter bank is substantially flush with the outer line of the ship's side.

Side mounting of the air intake means obviates the need for an intake funnel structure at a high level, thus reducing pressure loss and aerodynamic disturbance internally of the installation, and top weight and wind resistance on the superstructure. If the intake filter bank can be accommodated substantially completely within the ship's side as stated above, a further advantage accrues, in that disturbance of the airflow along the sides of the ship is reduced.

Also according to the present invention, there is provided a gas turbine powered ship having at least two hulls, the ship having superstructure comprising a main deck spanning the hulls, port and starboard external sidewalls, and respective port and starboard internal sidewalls spaced inboard from the external sidewalls, the port and starboard sides of the ship comprising said external sidewalls of the superstructure and corresponding sidewalls of the hulls, at least one of the hulls having a gas turbine engine located therein near the waterline, the gas turbine engine having its axis of rotation oriented in a fore and aft direction in vertical alignment with a position outboard of the superstructure's internal sidewall, air intake means, including a bank of air inlet filters, being mounted in the side of the superstructure sufficiently far above the waterline to avoid swamping of the air intake means in those seastates for which the ship is designed, air intake duct means leading from the intake means to the engine, and exhaust duct means leading from the engine to exhaust outlet means at a higher level than the intake means, at least the exhaust duct means being routed through the superstructure outboard of the superstructure's internal sidewall.

In addition to the previously mentioned advantage associated with the side-mounted intake filter bank, the stated positioning of the engine in the hull relative to the superstructure enables intrusion of intake and exhaust ducting into the main deck space to be avoided while minimising deviation of intake and exhaust ducting from a straight line path.

Preferably, at least the exhaust duct means is at least partly contained within the line of the superstructure's external sidewall, so as to minimise spoiling of the external lines of the ship.

If adequate space is provided between the superstructure's internal and external sidewalls, the intake and exhaust duct means can be routed between them to avoid any portion of the duct means being outboard of the line of the superstructure's external sidewall, thereby further minimising spoiling of the external lines of the ship.

Preferably, the sidewalls of the hulls extend convexly outboard beyond the external sidewalls of the superstructure sufficiently to enable the engine to be installed on the centreline of the hull and yet still be positioned directly below a position between the superstructure's external and internal sidewalls.

Preferably, the inlet filter bank is also housed in the space between the external and internal sidewalls of the superstructure. This further avoids spoiling of the external lines of the ship. However, if insufficient space is available to completely house the filter bank, it may be housed in an aerodynamically faired excrescence on the side of the superstructure.

Preferably, the intake duct means comprises a first section of ducting leading from the intake filter bank to a plenum chamber inn the hull and a second section of ducting leading from the plenum chamber to the engine, the engine being housed in its own enclosure and adapted to draw air from the plenum chamber.

Preferably, the plenum chamber is defined fore and aft by bulkheads in the hull and the interior of the gas turbine engine is hermetically sealed with respect to its own enclosure.

This design enables an installation to be housed in watertight compartments of relatively small volume, thereby reducing risks in the event of a collision.

The invention further includes marine gas turbine installation arrangements for the ships described above.

Exemplary embodiments of the invention will now be described with reference to the accompanying drawings, in which.

Figure 1A:
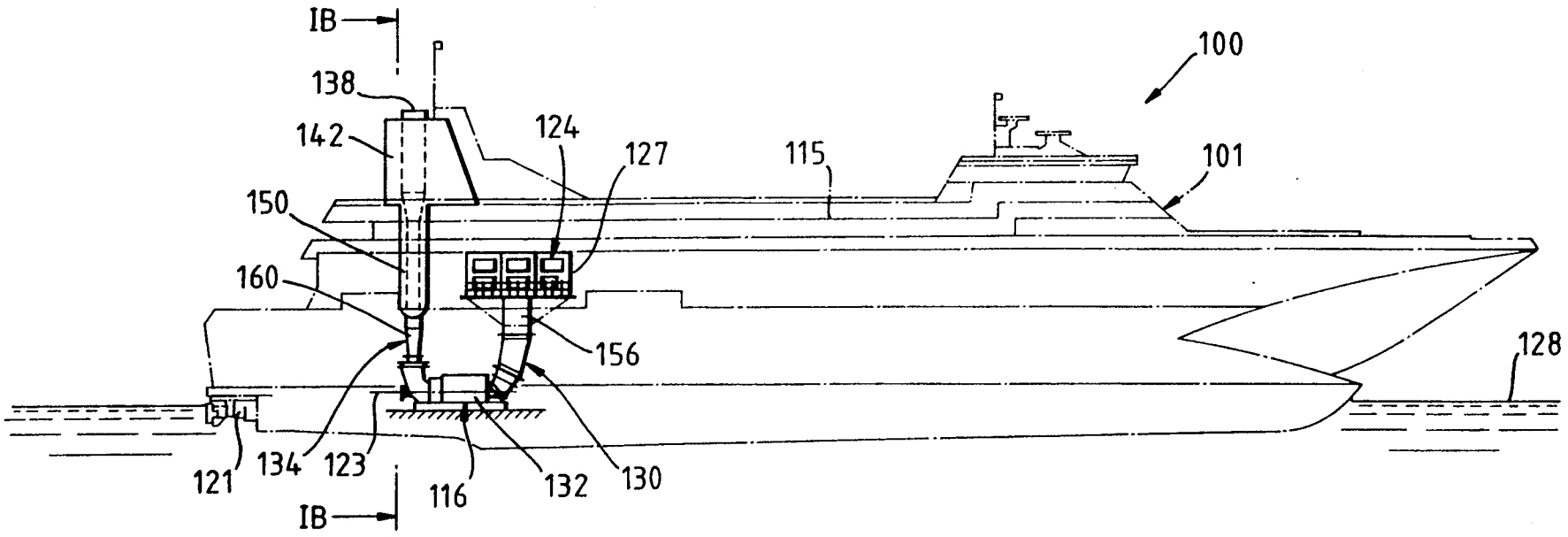
FIG. 1A is a side elevation of a twin-hulled catamaran type of RO-RO ferry in accordance with the invention, the overall lines of the vessel being indicated generally in "ghosted" form as broken lines and its gas turbine engine powerplant installation being shown in full lines.
Figure 1B:
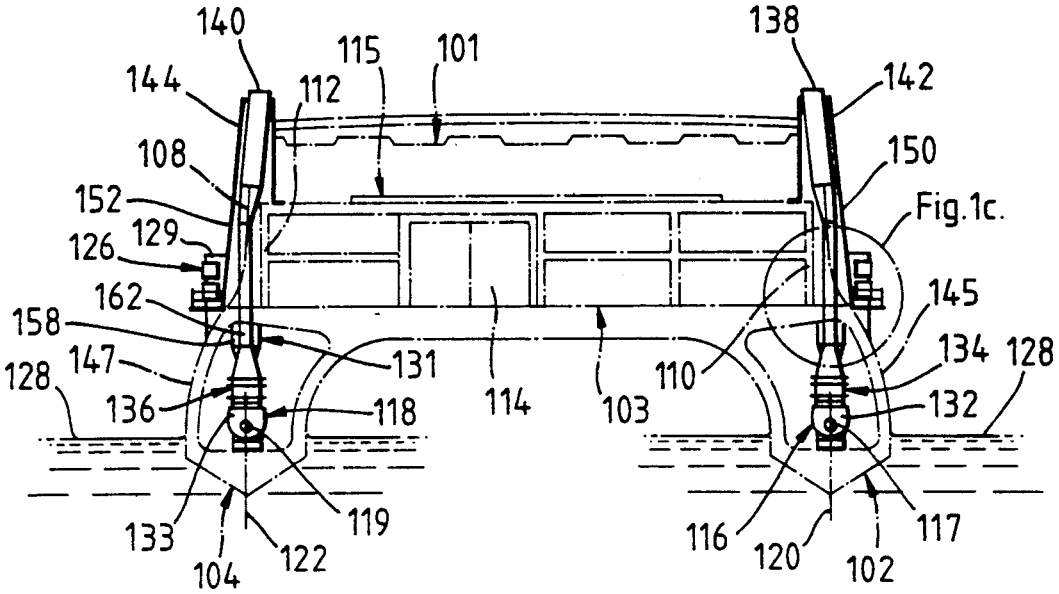
FIG. 1B is a view on section line I—I in FIG. 1A.
Figure 1C:
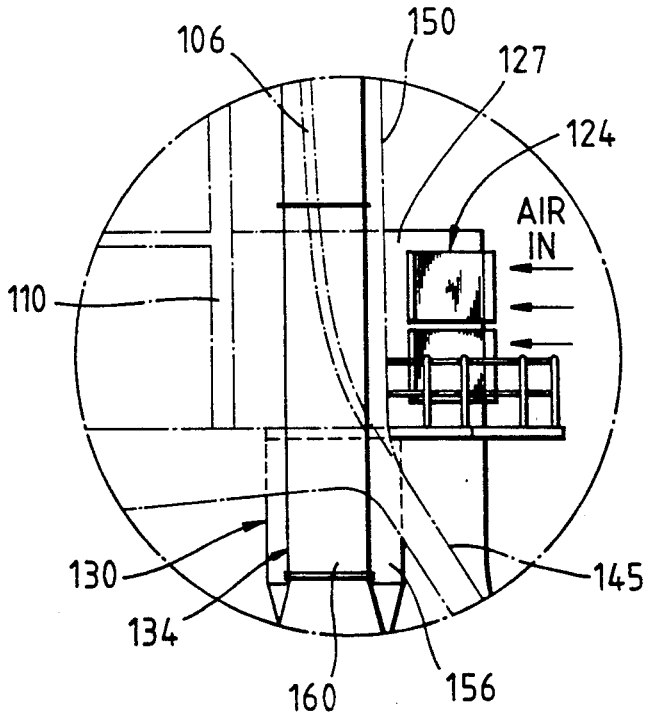
FIG. 1C is an enlarged view of part of the starboard side of FIG. 1B, the port side being substantially a mirror image of the starboard side.

Referring first to FIGS. 1A to 1C, the broken outline illustrates a high speed twin-hulled ferry ship 100. The overall architecture of the ship has superstructure 101 comprising a two-tier main deck 103 spanning the twin hulls 102,104, starboard and port external sidewalls 106,108 and—at main deck level—respective starboard and port internal sidewalls 110,112. These internal sidewalls 110,112 are spaced inboard from the external sidewalls 106,108 and define the outboard limits of the main deck loading space. Roll-on/roll-off access to the two tiers of the main deck 103 is through the large doors 114 at the aft of the main deck. Passenger decks 115 are provided above the main deck 103.

Each hull 102, 104 incorporates a gas turbine engine power plant 116,118 located on the centreline 120,122 of its keel and having its axis of rotation 123 oriented in a fore and aft direction. Each power plant 116,118 has a power output shaft which is coupled at 117,119 to a gearbox (not shown) whose output shaft (not shown) drives a waterjet propulsor 121.

Each power plant 116,118 receives air from an air intake filter bank 124,126 located in the side of the ship's superstructure sufficiently far above the fully loaded waterline 128 to avoid swamping of the filter bank in those seastates for which the ship is designed. Air intake ducting 130,131 leads from the intake filter bank 124,126 to the gas turbine engine enclosure 132,133. Exhaust ducting 134,136 leads from the engine enclosure 132,133 up to an exhaust outlet 138,140 at a higher level on the superstructure than the intake filter bank 124,126. In this embodiment, the exhaust outlet 138,140 is housed in a funnel-like structure 142,144 which forms the highest part of the superstructure.

The above described side mounting of the air intake filter bank 124,126 obviates the need for an enlarged or a separate high-level funnel structure to accommodate the intake ducting 130,131 as well as the exhaust ducting 134, 136. This reduces top weight and wind resistance on the superstructure.

The starboard and port sides of the ship comprise the external sidewalls 106,108 of the superstructure 101 and corresponding sidewalls 145,147 of the hulls 102,104. The hull sidewalls 145,147 bulge outboard beyond the downwardly extended lines of the superstructure's external sidewalls 106,108. This convexity enables the engine 116,118 to be installed on the centreline 120,122 of the keel and yet still be positioned relative to the superstructure's internal wall 110,112 such that outboard curvature of the intake and exhaust ducting, to avoid intrusion into the main loading deck space, is not required.

In the present embodiment, the gap between the superstructure's external and internal sidewalls 106,108 and 110,112 is insufficiently large to accommodate the intake filter bank 124,126. Therefore, the filter bank 124,126 is installed externally at the base of the superstructure's external sidewall 106,108 in a large, squat, three-sided housing 127,129 which merges downwardly into the convex line of the hull. The intake ducting 130,131 emerges from the base of the filter bank directly into the hull's interior, penetrating the starboard edge of the main deck 103.

The gap between the superstructure's external and internal sidewalls 106,108 and 110,112 is however large enough to partially accommodate the exhaust ducting 134,136. As can be seen in FIG. 1C, part of the ducting's periphery is contained inboard of the line of the superstructure's external sidewall 106,108 so as to minimise spoiling of the external lines of the ship. That portion of the periphery of the ducting which cannot be so contained is housed in an elongate blister 150,152 on the side of the ship, which extends up the side of the superstructure between the levels of the main deck 103 and an upper passenger deck 154.

Both the intake and the exhaust ducting comprise several shorter sections, one of which in each case comprises a silencer section 156, 158 and 160,162 incorporating noise absorbing splitters (not shown).

Figure 2A:
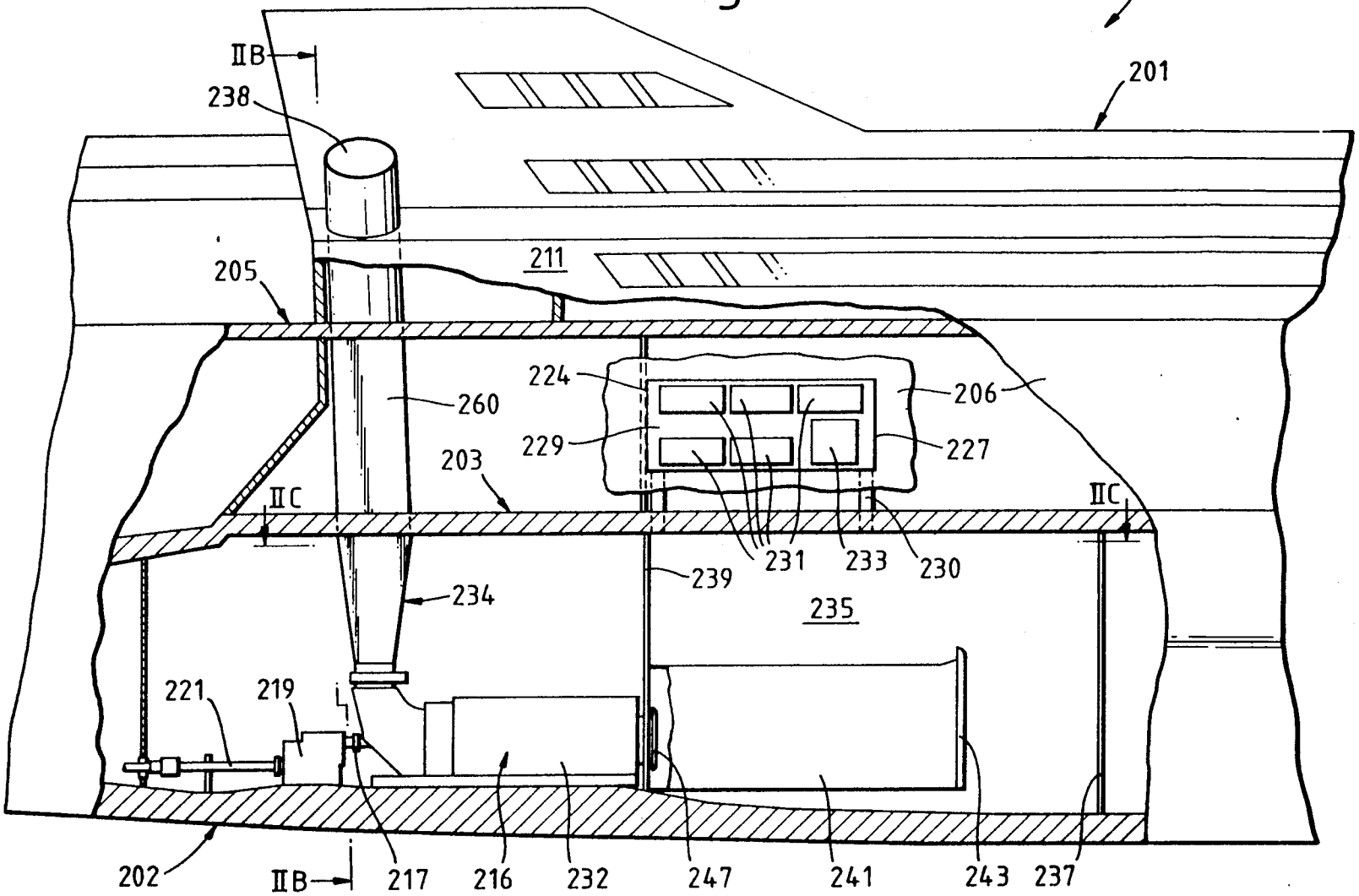
FIG. 2A is part of the starboard side elevation of a similar type of vessel with different architecture in which the starboard outer wall of the vessel has been partly broken away to reveal an alternative type of gas turbine engine powerplant installation.
Figure 2B:
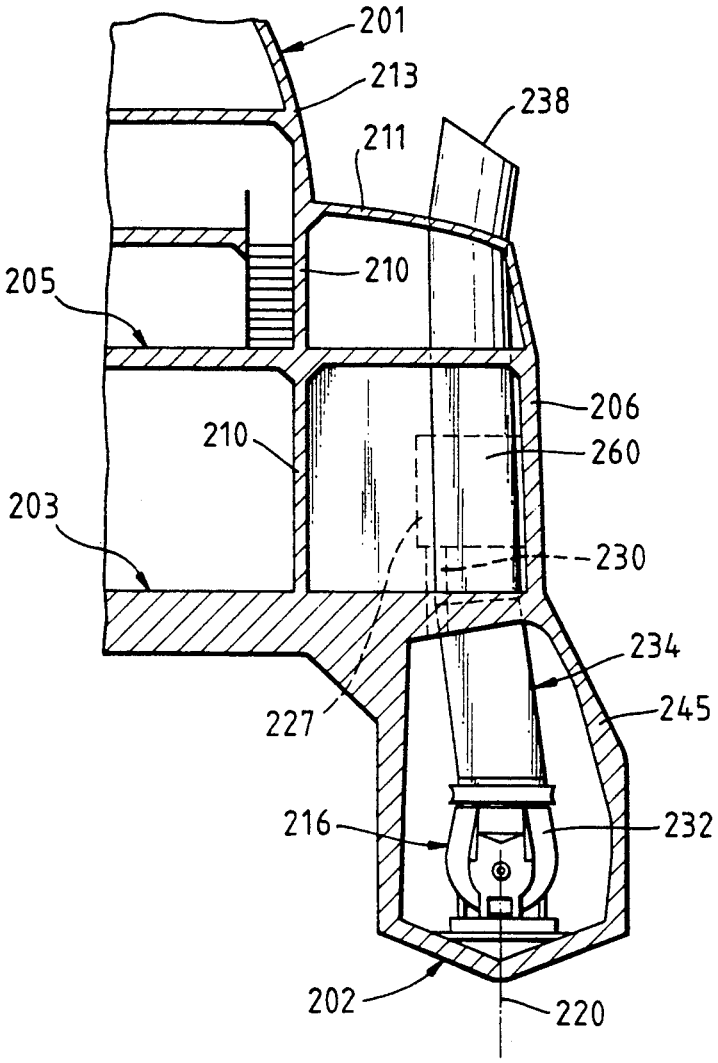
FIG. 2B is a partial view on section line IIB—IIB in FIG. 2A.
Figure 2C:
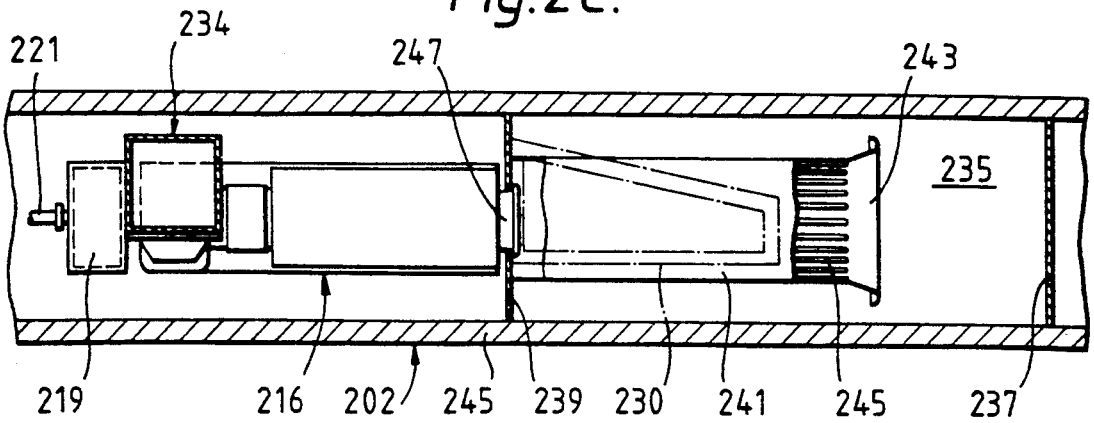
FIG. 2C is a partial view on section line IIC—IIC in FIG. 2A showing a plan view of the engine installation within the hull.

Referring now to FIGS. 2A to 2C, although the ship 200 is the same general type as the previous embodiment, its architecture is somewhat different. For simplicity, only the starboard side of the ship is illustrated and for the purposes of the description it will be assumed that the port side of the ship is a mirror image of the starboard.

The superstructure 201 comprises a single tier main deck 203 with several tiers of passenger decks 205. Roll-on/roll-off access to the main deck 203 is again through large doors (not shown) at the aft of the main deck. However, the superstructure's external sidewall 206 at main deck level is more vertically disposed than are its equivalents in FIG. 1. It then steps abruptly inboard to join the top of the superstructure's internal sidewall 210 to form a pitched roll 211 at the level of the second tier in the passenger decks 205. Above this level the superstructure has only an external structural wall 213.

The internal sidewall 210 again defines the outboard limits of the main deck loading space, but at a station further inboard than its equivalents in FIG. 1. The space between the external and internal sidewall 206,210 is therefore much greater than the equivalent in FIG. 1 and can be used not only for storage and services, but also to contain and conceal the air intake and exhaust structures as described below.

Again, the hull 202 incorporates a gas turbine engine power plant 216, located on the keel centreline 220 and oriented in a fore and aft direction. The power plant 216 has a power output shaft which is coupled at 217 to a gear box 219 whose output shaft 221 drives a propulsor (not shown).

The power plant 216 receives are from a bank of air intake filters 224 installed in a housing 227. This is located in the side of the ship's superstructure at a level between the main deck 203 and the first tier of passenger decks 205, being contained between the superstructure's external and internal sidewalls 206,210. Only the substantially planar front face 229 of the housing 227 is visible in the side of ship. The front face 229 of the housing 227 has five identical filter inlets 231 and an air bypass door 233 which only opens in an emergency if the filters become blocked.

Looking particularly at FIGS. 2A and 2C, a short length of air intake ducting 230 (whose position is shown in broken lines in FIG. 2C) leads from the intake filter bank 224 directly into the hull 202 through the starboard edge of the main deck 203. The ducting emerges into a plenum chamber 235 from which the gas turbine engine draws its air. Chamber 235 is defined between two adjacent watertight bulkheads 237 and 239 of the hull, such that in the event of puncture of the hull, water is contained within chamber 235 and the carcass of the engine 216, whose interior is sealed against ingress or egress of water with respect to its own watertight enclosure, also defined between a part of bulkheads 239 and 240.

Within the chamber 235 is further intake ducting comprising a cylindrical air inlet 241 for smoothing the flow of air into the engine. It has a bell mouth 243 to avoid turbulence due to air flowing directly into the inlet 241 past a sharp edge. In FIG. 2C a forward part of the inlet 241 is shown with its top portion broken away to reveal noise absorbing splitters 245.

Inlet 241 has its aft end fixed to the bulkhead 239. It surrounds a smaller bell mouthed duct 247 which penetrates the bulkhead 239 and carries the air directly into the gas turbine engine enclosure 232.

Exhaust ducting 234 leads from the engine enclosure 232, up through the space between the external and internal sidewall 206,210, to an exhaust outlet 238 on the roof 211. Hence, in this embodiment, the exhaust outlet 238 does not require a funnel-like structure on the highest part of the superstructure, thereby reducing top weight and wind resistance.

As in the previous embodiment, the hull sidewall 245 extends convexly outboard beyond the downwardly extended lines of the superstructure's external sidewall 206. This enables the engine 216 to be installed on the centreline 220 of the keel with the exhaust ducting passing directly up the inside of the internal sidewall 210, thereby efficiently using the space between the external and internal sidewalls 206,210.

In the present embodiment, the gap between the superstructure's external and internal sidewalls 206,210 is sufficiently large to accommodate the intake filter bank 224, the part of the intake ducting connecting thereto, and the exhaust ducting 234, 136. This substantially avoids spoiling the external lines of the ship.

The exhaust ducting comprises several shorter sections, one of which comprises a silencer section 260 incorporating noise absorbing splitters (not shown).

I claim:

1. A gas turbine powered ship having at least one gas turbine engine located in a hull of the ship, an air intake filter bank located in the side of the ship sufficiently far above the waterline to avoid swamping of the filter bank in those seastates for which the ship is designed, air intake duct means leading from the intake filter bank to said engine, and exhaust duct means leading from the engine up to exhaust outlet means at a higher level than said intake filter bank.

2. A ship according to claim 1, in which the intake filter bank is housed substantially completely within the side of the ship such that the outer surface of the filter bank is substantially flush with the outer line of the ship's side, thereby to minimise disturbance of the airflow along the sides of the ship.

3. A gas turbine powered ship having at least two hulls, the ship having superstructure comprising a main deck spanning the hulls, port and starboard external sidewalls, and respective port and starboard internal sidewalls spaced inboard from the external sidewalls, the port and starboard sides of the ship comprising said external sidewalls of the superstructure and corresponding sidewalls of the hulls, at least one of the hulls having a gas turbine engine located therein near the waterline, the gas turbine engine having its axis of rotation oriented in a fore and aft direction in vertical alignment with a position outboard of the superstructure's internal sidewall, air intake means, including a bank of air inlet filters, being mounted in the side of the superstructure, air intake duct means leading from the intake means to the engine, and exhaust duct means leading from the engine to exhaust outlet means at a higher level than the intake means, at least the exhaust duct means being routed up the superstructure outboard of the superstructure's internal sidewall.

4. A gas turbine powered ship according to claim 3, in which at least the exhaust duct means is at least partly contained within the line of the superstructure's external sidewall, so as to minimise spoiling of the external lines of the ship.

5. A gas turbine powered ship according to claim 3, in which the intake and exhaust duct means are routed between the superstructure's internal and external sidewalls to avoid any portion of the duct means being outboard of the line of the superstructure's external sidewall.

6. A gas turbine powered ship according to any one of claims 3 to 5, in which the sidewalls of the hulls extend convexly outboard beyond the external sidewalls of the superstructure sufficiently to enable the engine to be installed on the centreline of the keel and yet still be positioned outboard of the superstructure's internal sidewalls.

7. A gas turbine powered ship according to claim 6, in which the inlet filter bank is housed between the external and internal sidewalls of the superstructure.

8. A gas turbine powered ship according to claim 6, in which the inlet filter bank is at least partially housed in an excrescence on the side of the superstructure.

9. A gas turbine powered ship according to claim 8, in which the gas turbine engine is housed in its own enclosure defined between bulkheads in the hull.

10. A gas turbine powered ship according to claim 6, in which the gas turbine engine is housed in its own enclosure defined between bulkheads in the hull.

11. A gas turbine powered ship according to claim 10, in which the interior of the gas turbine engine is effectively sealed against ingress and egress of water thereto by said enclosure.

12. A gas turbine powered ship according to claim 10, in which an interior of the gas turbine engine is effectively sealed against ingress and egress of water thereto by said enclosure.

13. A gas turbine powered ship according to claims 1 to 3, in which the intake duct means comprises a first section of ducting leading from the intake filter bank to a plenum chamber in the hull and a second section of ducting leading from the plenum chamber to the engine, the engine being adapted to draw air from the plenum chamber.

14. A gas turbine powered ship according to claim 13, in which the plenum chamber is defined for and aft by bulkheads in the hull.

15. A gas turbine powered ship having at least one gas turbine engine located in a hull of the ship, an air intake filter bank located in the side of the ship sufficiently far above the waterline to avoid swamping of the filter bank in those seastates for which the ship is designed, air intake duct means leading from the intake filter bank to the engine, and exhaust duct means leading from the engine up to exhaust outlet means at a higher level than the intake filter bank, wherein the engine is disposed such that a rotational axis thereof is oriented so as to be substantially horizontal in a normal operation attitude of the ship.

16. A gas turbine powered ship having at least one gas turbine engine located in a hull of the ship, an air intake filter bank located in the side of the ship, air intake duct means leading from the intake filter bank to the engine, and exhaust duct means leading from the engine up to exhaust outlet means, wherein the air intake duct means includes a first section of ducting leading from the intake filter bank to a plenum chamber in the hull and a second section of ducting leading from a location within the plenum chamber to the engine, the engine being able to draw air from the plenum chamber.

* * * * *